US005543578A

United States Patent [19]

Colvin, Sr. et al.

[11] Patent Number: 5,543,578

[45] Date of Patent: Aug. 6, 1996

[54] RESIDUAL EXCITED WAVE GUIDE

[75] Inventors: Bryan J. Colvin, Sr., San Jose; Perry R. Cook, Palo Alto; Daniel Gochnauer, Saratoga, all of Calif.

[73] Assignee: Mediavision, Inc., Fremont, Calif.

[21] Appl. No.: 115,958

[22] Filed: Sep. 2, 1993

[51] Int. Cl.[6] ..... G10H 1/057; G10H 1/12

[52] U.S. Cl. ..... 84/622; 84/625; 84/659; 84/692

[58] Field of Search ..... 84/601–604, 622–625, 84/647, 659–661, 692, 697

[56] References Cited

U.S. PATENT DOCUMENTS

| | | | |
|---|---|---|---|
| 4,611,522 | 9/1986 | Hideo | 84/1.01 |
| 4,622,877 | 11/1986 | Strong . | |
| 4,649,783 | 3/1987 | Strong et al. . | |
| 4,909,121 | 3/1990 | Usa et al. . | |
| 4,984,276 | 1/1991 | Smith . | |
| 5,029,509 | 7/1991 | Serra et al. | 84/625 |
| 5,157,216 | 10/1992 | Chafe | 84/695 |
| 5,212,334 | 5/1993 | Smith, III . | |
| 5,248,845 | 9/1993 | Massie | 84/622 |
| 5,256,830 | 10/1993 | Takeuchi et al. | 84/625 |

OTHER PUBLICATIONS

Smith, Physical Modeling Using Digital Waveguides, Mass. Inst. of Tech. Computer Music Journal, vol. 16, No. 4, 1992.

*Primary Examiner*—Vit W. Miska

*Attorney, Agent, or Firm*—Claude A. S. Hamrick; Robert O. Guillot

[57] ABSTRACT

Synthesizer models for emulating musical instruments can be improved using an analysis model that compares the output signal of the model to a recording of a desired sound and derives a residual signal that can be used to correct the model. When the original model is a good one, the residual signal is small and takes much less memory to store than is required for a sampled sound.

16 Claims, 3 Drawing Sheets

RESIDUAL EXCITED WAVE GUIDE

BACKGROUND OF THE INVENTION

1. Field of the Invention

This invention relates to improving sound synthesis models. In particular, a sound synthesis model is analyzed for accuracy and improved by correcting for discovered error.

2. Description of Related Art

Many sound synthesis methods attempt to emulate the sounds created by musical instruments, such as drums or pianos or horns. For example, digital sound synthesis methods attempt to mimic a sound by creating a signal which has a series of digital values that represent the amplitude of a sound wave. The most accurate digital method of emulation is sample synthesis. Sample synthesis synthesizes sound by playing a recording of a desired sound. Sample synthesis is commonly used in drum machines were only a few distinct sounds are synthesized.

In some applications, sample synthesis requires too much memory to be practical. For example, in a piano emulation, a digital recording of the lowest note may last up to 30 seconds. This is more than 2 megabytes of 16-bit values if the recording is sampled at a rate of 44.1 KHz. Multiply this by the 88 keys on a standard piano and the storage goes over 200 megabytes. Pianos also have different timbres depending on how hard a key is hit. A standard Musical Instrument Digital Interface (MIDI) has 128 different velocity curves so the storage now goes up to 30 gigabytes.

Even if all these sounds were recorded, you would still not have an instrument that sounds like a real piano. The effect of the damper pedal and inter-string coupling would be missing. The damper pedal couples all the strings together through a sound board. Further, when a chord is held down, with or without the damper pedal, the struck strings couple together.

A better sample synthesis might record combinations of keys being hit together. Taking all possible combinations of 2 out 88 keys, 3 out of 88 keys, and so on up to 88 out of 88 keys yields an astronomical number of combinations, and still does not take into account the effect of time offsets. Sample synthesis therefore cannot practically yield a perfect piano sound. The standard solution to this problem is to sample only some of the notes and then use models to interpolate the notes and combinations of notes not sampled.

There are many sound synthesis methods beside sample synthesis. Currently, the most prevalent synthesis method is "wave table" synthesis. Wave table synthesis uses two circular sound tables. One table represents the sound during the attack, and the other table represents the steady state. Two ADSR (Attack, Decay, Sustain, and Release) curves control the envelope for each table. For instruments that don't have a steady state, a third ADSR curve is typically used to control filter parameters. Often the attack table may be replaced by a sampled attack. This effect is what most "sampled" libraries do.

Wave guide synthesis is a music synthesis method that mimics a musical instrument using models based on the physical structure of the instrument. The theory of lossless wave guides simplifies calculations needed to model many musical instruments. A specific case of wave guide synthesis is the plucked string algorithm which may be used to emulate the sound of a plucked string. The plucked string algorithm involves filling a section of memory with initial data. The section of memory is called a delay line.

FIG. 1 shows a block diagram of a prior art sound emulation model 100 which uses the plucked string algorithm to produce a digital signal Y'. The emulation model 100 employs a delay length 101 and a feedback gain 102. To produce the digital signal Y', data is read sequentially from the delay line 101 and scaled by the feedback gain 102 to account for sound evolution. Alternatively, data from the delay line 101 may be filtered or otherwise processed. The output signal Y' is fed back into the delay length 101, typically by overwriting memory. Once the last of the data in the delay line 101 has been read, reading begins again from the beginning. Reading from the delay line 101 continues in circular fashion for the duration of the sound signal Y'. The sound signal Y' evolves because scaling changes values of data in the delay line 101 but also repeats at a frequency that depends on the number of data points in the delay line 101 and the rate at which the data is sampled.

Generally, a synthesis model based on prior art methods will not perfectly reproduce the sound made by a musical instrument, and methods are needed which improve the accuracy of a model but do not require excessive memory.

SUMMARY OF THE INVENTION

The present invention provides sound synthesis models (or emulations), analysis models for improving the accuracy of sound synthesis, and methods for improving sound synthesis. The emulations and analysis models may be implemented in hardware or software.

According to one embodiment the present invention, an output signal from a sound synthesis model is compared to a digital recording of a desired sound, the desired sound being the sound that the synthesis model is intended to emulate. The comparison provides a residual signal which is the error or difference between the desired signal and the signal actually generated by the sound synthesis model. An improved synthesis model is then constructed which combines the residual signal with the output signal of the original model to produce a more accurate sound. The improved model has about the same accuracy as sample synthesis, but generally requires much less memory.

Memory requirements for a residual signal are less than memory requirements for sample synthesis for many reasons. If the synthesis model is perfect, the residual signal is zero. No memory is required to save the residual signal. If the model is good but not perfect, the residual signal is generally small compared to the desired signal. Often the residual signal may be stored with less dynamic range than a desired signal. For example, if the original synthesis model produces 16-bit values, the residual signal may be small enough to only require 8 bits to expressed. Also, in many cases, least significant bits of residual signal vary in a nearly random manner and represent unpredictable or variable parts of a sound being simulated. The random portion of the residual signal need not be saved in memory because the random portion can be ignored or generated using a random number generator as needed.

Further, the duration of the residual signal is typically shorter than the desired signal. In a good model, as the volume of the sound decreases, the residual signal decreases even faster and becomes insignificant. The significant portion of the residual signal, being of shorter duration than the desired sound, can be stored using less memory.

In some cases, the residual signal is nearly random and reflects a random or unpredictable part of the sound being simulated. When the residual signal is random, the residual signal can often be replaced with enveloped white noise. This drastically reduces the memory required to store the residual signal because only parameters which describe an envelope are stored.

Analysis models according to the invention can be used to fine tune parameters of a synthesis model, and further reduce the size of the residual signal.

DETAILED DESCRIPTION OF THE PREFERRED EMBODIMENTS

Most sound emulations produce signals which are either analog voltages that vary with time or digital signals that change periodically to represent the variation of sound waves. Methods for converting either type of signal to sound are well known. For example, a digital signal can be converted to an analog signal using a digital-to-analog converter. Sound is typically produced from analog signals using an amplifier and speakers.

The following description of specific embodiments of the present invention is limited to digital sound synthesis models. However, in view of the following description, applications of the invention to the analog sound synthesis should be apparent to those skilled in the art.

Figure 1:
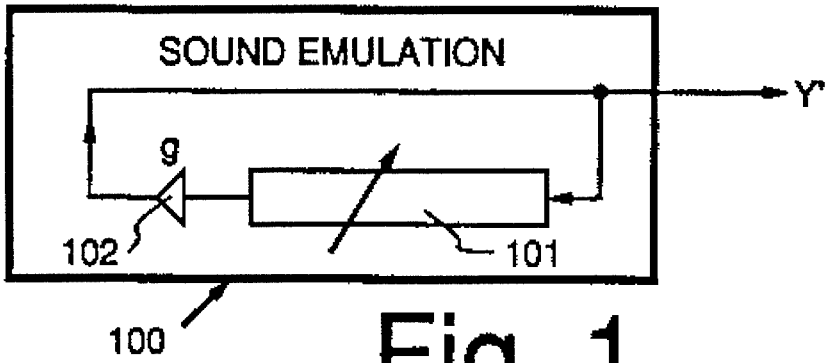
Fig. 1 (PRIOR ART)
FIG 1 shows a block diagram of a prior art sound synthesis model.

In the prior art model of FIG. 1, emulation model 100 produces the digital signal Y' that represents a sound amplitude. If the emulation 100 were perfect, signal Y' would equal a digitally recorded signal S of the sound being emulated. If the emulation 100 is not perfect, signal Y' differs from desired signal S by some residual signal.

Sound emulation model 100 represented in FIG. 1 is a plucked string model and is used here as an example of a synthesis model. As described more fully below, many different emulations may be used with embodiments of the present invention. The plucked string model of FIG. 1 employs delay length 101 and feedback gain 102. Signal Y' which represents a sound amplitude is fed back into the delay length 101 for generation of subsequent sound amplitudes values. In general, sound amplitude values from a sound emulation depend on both fixed parameters and on preceding sound amplitude values.

Figure 2:
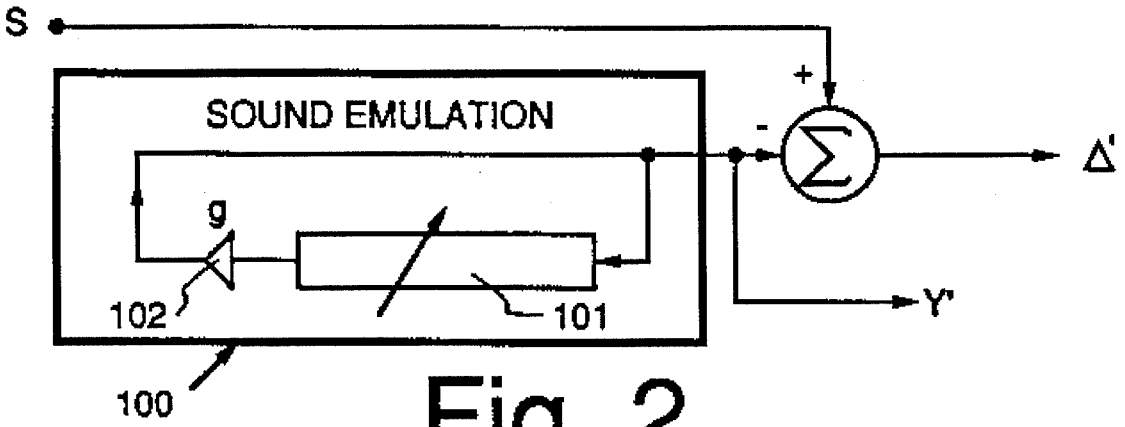
FIG. 2 shows an analysis model for use with the synthesis model of FIG. 1 according to an embodiment of the present invention.

FIG. 2 shows an analysis model according to one embodiment of the invention. Like elements in FIGS. 1 and 2 have the same reference number. The analysis model subtracts signal Y' from desired signal S and generates residual signal Δ'. Residual signal Δ' can be recorded for use with an improved synthesis model, described below. Methods for recording the residual signal Δ' include, but are not limited to, storing values of the residual signal Δ' in a non-volatile memory such as a ROM, a floppy disk, or a hard disk. Typically, the analysis model is used by designers of sound synthesizers, and is not used during sound synthesis.

Figure 3:
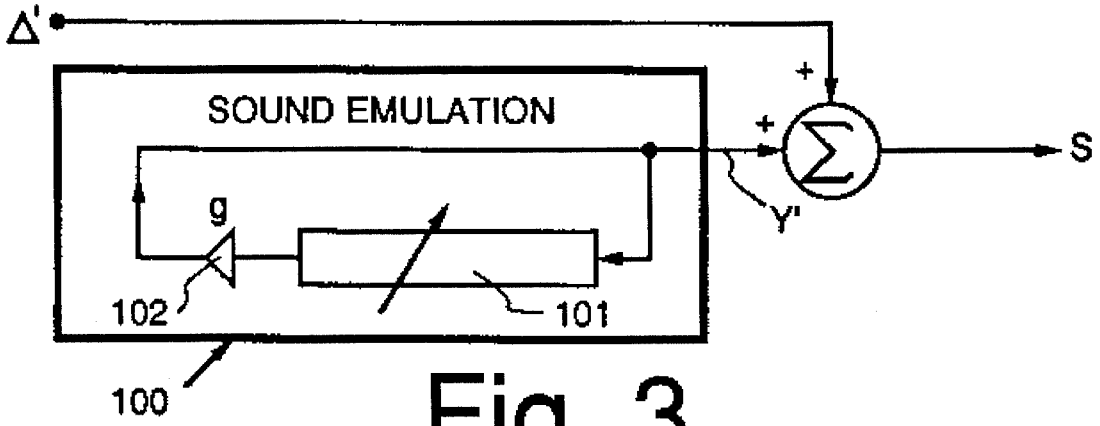
FIG. 3 shows an improved synthesis system derived from the initial synthesis model of FIG. 1 using the analysis model of FIG. 2.

FIG. 3 shows an improved synthesis system according to an embodiment of the invention. Like elements in FIG. 3 and previous figures have the same reference numbers. The improved emulation is derived from the original emulation 100 using the analysis model of FIG. 2. The improved model adds the signal Y' and the residual signal Δ' to generate an output signal identical to the desired signal S.

The improved synthesis system of FIG. 3 is the inverse of the analysis model of FIG. 2. The analysis model takes the desired signal S as an input signal and produces the residual signal Δ'. The improved synthesis system takes the residual signal Δ' as an input signal and produces an output signal equal to the desired signal S. This feature also is seen in other embodiments of the invention discussed below.

Figure 4:
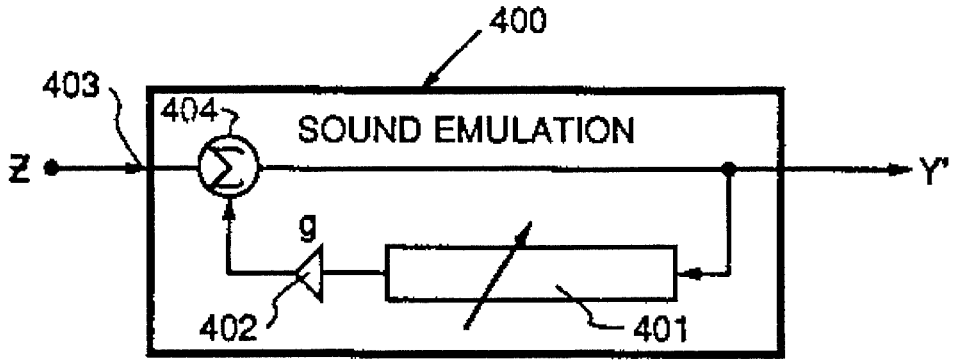
FIG. 4 shows the sound synthesis model of FIG. 1 adapted to accept an input signal.

FIG. 4 shows an emulation 400 which is a modification of the emulation 100 shown in FIG. 1. The emulation 400 contains a delay length 401 and feedback gain 402 which are the same as the delay length 101 and feedback gain 102 shown in FIG. 1. FIG. 4 further includes a summing element 404. The summing element 404 adds an input signal Z to the signal from the feedback gain 402. If the input signal Z is always zero, the emulation 400 is equivalent to the emulation 100. That is, both emulations 100 and 400 produce the same output signal Y'.

Figure 5:
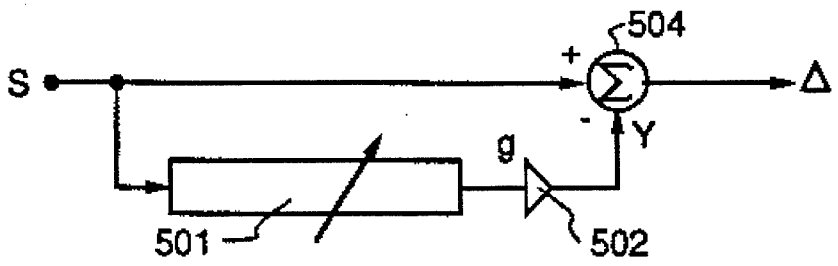
FIG. 5 shows an analysis model according to another embodiment of the present invention.

FIG. 5 shows an analysis model, according to one embodiment of the invention, that can be constructed from emulation 100 or 400. A delay length 501 and a feedback gain 502 in FIG. 5 are identical to the delay length 101 and feedback gain 102 in FIGS. 1 and 2. In FIG. 5, the desired signal S feeds into the delay line 501. This differs from FIG. 2 where the signal Y' from the emulation 100 feeds back into the delay length 101. The different input signals into the delay lines 101 and 501 cause signals Y and Y' to be different. Accordingly, a summing means 504 in FIG. 5 subtracts signal Y from the desired signal S to generate a residual signal Δ, rather than Δ'.

If the emulation 100 is a good one, signals Y', Y, and S are all approximately equal. But, because the input signal S fed into the delay line 501 is the desired signal, the output signal Y tends to be more accurate than signal Y' and the residual signal Δ tends to be smaller than the residual signal Δ'. As above, the residual signal Δ can be recorded for later use in an improved synthesis system.

Figure 6:
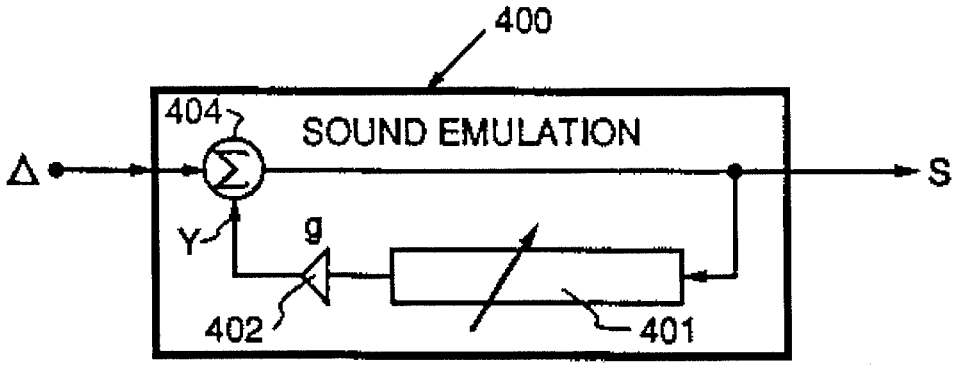
FIG. 6 shows an improved synthesis system derived from the synthesis model of FIG. 4 using the analysis model of FIG. 5.

FIG. 6 shows an improved synthesis system that uses the residual signal Δ. Like elements in FIGS. 4 and 6 are numbered the same. FIG. 6 is identical to FIG. 4 except the error function Δ is the input signal rather than a zero signal Z. Residual signal Δ is added to signal Y to give an output signal equal to the desired signal S. The signal S is input into a delay length 401 just as in the analysis model of FIG. 5, so the signal from feedback gain 402 is indeed Y. The improved synthesis system of FIG. 6 is the inverse of the analysis model of FIG. 5.

Figure 7:
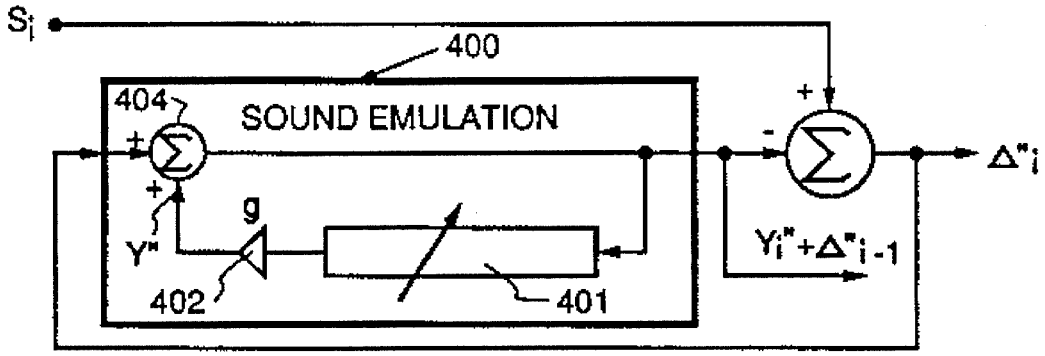
FIG. 7 shows still another alternative analysis model according to an embodiment of the present invention.

FIG. 7 shows another embodiment of an analysis model according to the present invention. The analysis model of FIG. 7 generates residual signal Δ" from the emulation 400. Elements in FIG. 7 have the same reference numbers as like elements in previous figures. As can be seen in FIG. 7 a signal Y" from an emulation 400 is subtracted from desired signal S to generated residual signal Δ". FIG. 7 shows the signals S, Y", and Δ" with a time index, i or i-1. This analysis model differs from the analysis model of FIG. 5 in that the residual signal Δ" is fed back into model 400 and added to the signal Y". It also differs from the analysis model of FIG. 5 because the residual signal value $\Delta''_{i-1}$ and the signal $Y''_i$ come from different sampling periods. In FIG. 7, $Y''_i+\Delta''_{i-1}+\Delta''_i$ equals $S_i$. Accordingly, Δ" typically does not equal Δ.

For a good model, the residual signal Δ" is generally small, and changes between successive values of the residual signal Δ" are even smaller. Adding residual signal $\Delta''_{i-1}$ from the preceding sampling period to the signal $Y''_i$ tends to make the signal fed into delay line 401 closer to S and decreases subsequent errors $\Delta''_i$.

Figure 8:
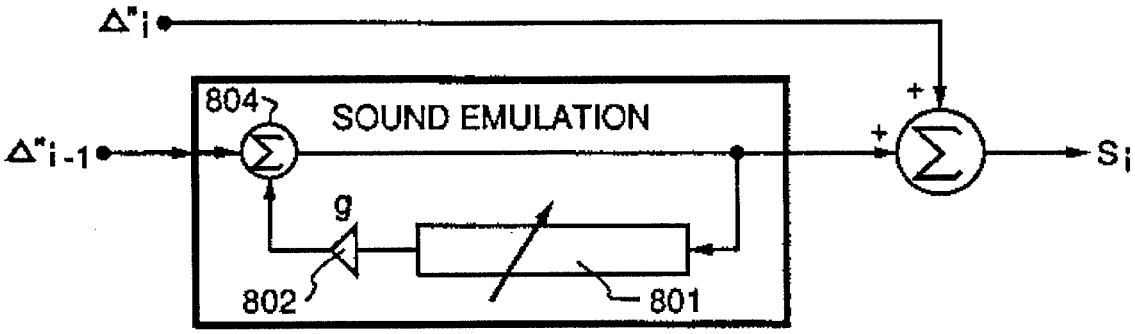
FIG. 8 shows an improved synthesis system derived from the synthesis model of FIG. 4 using the analysis model of FIG. 7.

FIG. 8 shows an improved synthesis system that is derived from the emulation 400 using the analysis model of FIG. 7 The residual signal $\Delta''_{i-1}$ with an appropriate time index is fed into the emulation 400, and the residual signal $\Delta''_i$ is added to the result to yield an output sound signal that is equal to the desired signal S. The improved synthesis system of FIG. 8 is the inverse of the analysis model of FIG. 7.

In many cases, the residual signal Δ" and the model are such that an improved synthesis system such as shown in FIG. 4 may be used in place of the improved synthesis system shown in FIG. 8. The improved synthesis system of FIG. 4, when used with residual signal Δ" from the analysis model of FIG. 7, does not give an exact replication of the desired signal S because of the difference in the time index mentioned above. The improved synthesis model of FIG. 4 is not the exact inverse of the analysis model of FIG. 7. However, in general, a shift of the residual signal by one sampling period is an immaterial change.

Although FIGS. 2 through 8 use delay lengths and feedback gains identical to the original emulation 100, analysis models may also be used to optimize the parameters, such as the magnitude of the feedback gain or the length of the delay line. For example, the magnitude of the feedback gain can be varied and residual signals $\Delta(g_1)$ and $\Delta(g_2)$ generated for feedback values $g_1$ and $g_2$. A best feedback gain, $g_1$ or $g_2$, is chosen which gives the smallest residual signal, and the best feedback gain is used in the improved model. In a more general case, one or more of the parameters of an emulation can be fine tuned to find the minimum residual signal, and the fine tuned values used in an improved emulation.

Figure 9:
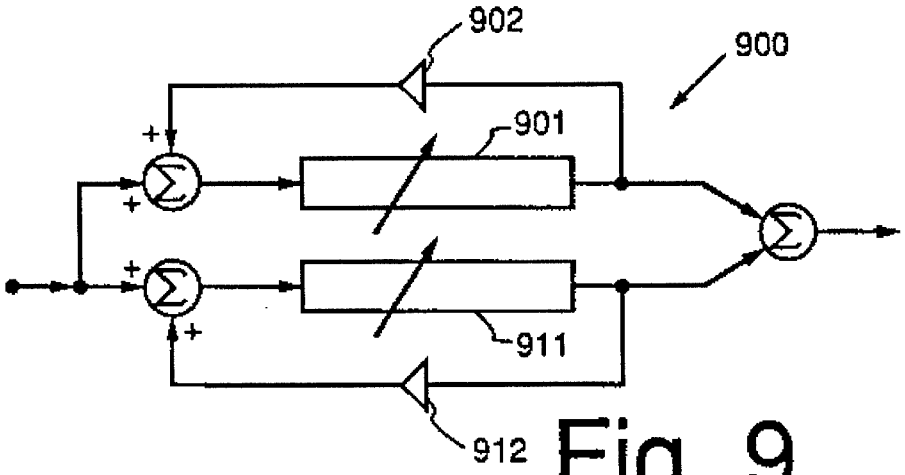
FIG. 9 shows a more complex synthesis model that can be improved using methods in accordance with the invention described herein.

The analysis models shown in FIGS. 2 and 7 and the resulting improved synthesis systems of FIGS. 3 and 8 can be applied to almost any emulation or synthesis model. That is, in FIGS. 2, 3, 7, and 8, the emulations 100 or 400 can be replaced by almost any emulation without materially changing the operation described above. The methods are the same regardless of the form or complexity of the emulation. For example, FIG. 9 shows a wave guide synthesis emulation 900 that includes two plucked string emulations. When the two plucked strings are slightly detuned the model of FIG. 9 is a simple emulation of a piano. The emulation 900 can replace the emulation 100 or 400 in FIGS. 2, 3, 7, and 8. Application of the methods remains as described above.

The analysis model of FIG. 5 requires a synthesis emulation which uses the desired sound signal S as an input signal for generating future sound amplitude values. An emulation such as emulation 900 which does not directly use the sound signal S cannot use the analysis model of FIG. 5. (The feedback gains 902, 912 feed back into the delay lines 901, 911 only the signals from a single string emulation, not the entire sound signal.) For synthesis models such as model 900, the analysis model of FIG. 5 cannot be used.

For all of the above described embodiments, improved accuracy requires memory to store the residual signal. If the residual signal required as much data storage as the desired signal S, the improved model would have no advantage over sample synthesis. However, if the original model is good, the residual signal is small or becomes small quickly, and the residual signal requires much less memory storage. Many techniques may be used with the above described embodiments to reduce the amount of memory needed to store the residual signal.

Often only the initial attack of a note is difficult to model. For example, complicated things can happen to a string while it is being struck, but after the initial strike, the modes of vibration of the string are more predictable. Consequently, in many applications the residual signal is significant during the attack but goes to zero or becomes insignificant a short time later. The insignificant portion of the residual signal, the portion that falls below a chosen minimum value, can be truncated and only the significant portion recorded. The residual signal, being of shorter duration, takes much less memory to store than does the desired signal S.

Also, the residual signal is often small compared to the maximum possible amplitude of the desired signal S, and the residual signal can be saved using fewer bits. For example, if the sound signal S has 16-bit values but the residual signal never has a magnitude larger than 127, the most significant bits are zero and need not be recorded. The residual signal can be stored using 8 bits per value rather than 16, thus cutting the storage in half.

Further, the residual signal often has random portions that do not need to be stored. Many residual signals have erratic variations that represent an unpredictable part of a sound. For example, recordings of a flute playing the same note are all basically similar but are not always the same because of unpredictable variation in air flow through the flute. These sorts of unpredictable effects often show up as random variations that only affect the least significant bits of residual signal. When the least significant bits show a random variation, the least significant bits need not be saved in memory. The least significant bits can be truncated, reducing the memory required to save the residual signal. On play back, the residual signal can be used with the random bits all zero or, alternatively, with new random bits generated using a white noise generator.

In some residual signals, the unpredictable part is dominant and the residual signal seems to vary randomly with only a general trend in the magnitude of the variation. In these cases, the memory requirements of the residual signal can be decreased to only the parameters needed for an envelope that describes the trend of the random variation. On play back, the residual signal is reproduced by a random signal from a white noise generator that is scaled to the size of the stored envelope.

When a synthesis system such as depicted in FIG. 6 or 8 is used, the residual signal can provide the initial conditions. For example, in wave guide synthesis, initial data is often stored in memory and fed into delay lines. The initial data controls the initial sound generated and to some extent the evolution of the sound. Using the above described methods, the original model can be analyzed with different initial data. The initial data can be changed to values that requires less memory to store, for example, cleared or fixed to any chosen value. With the initial data changed, the model is less accurate, but the analysis models described above generate a residual signal that corrects for inaccuracy in the model caused by the changed initial data.

Memory need not be used to hold both initial data and residual signal. Typically, using incorrect initial data does not increase the memory space taken by the residual signal. Initial data is most important at the beginning of a sound, so most of the correction for changed initial data occurs during the first few vibrations of the sound amplitude. This is exactly when the residual signal is expected to be significant anyway. Accordingly, the duration of the residual signal is not increased, but the memory required to store the initial data is decreased. Net memory required for accurate synthesis is reduced by changing the initial data.

Although the present invention has been described with reference to particular embodiments, the description is only an example of the invention's application and should not be taken as a limitation. The scope of the present invention is defined only by the following claims.

We claim:

1. A method for synthesizing a desired sound signal comprising the steps of:

using a sound synthesis model to generate an initial sound signal;

generating a recorded residual signal by subtracting said initial sound signal from a desired sound signal;

combining said recorded residual signal with said initial sound signal to generate a final sound signal; and feeding said recorded residual signal into said sound synthesis model, wherein values of said initial sound signal generated by the sound synthesis model depend on values of the recorded residual signal.

2. A method for synthesizing a desired sound signal comprising the steps of:

using a sound synthesis model to generate an initial sound signal;

generating a recorded residual signal by subtracting said initial sound signal from a desired sound signal;

combining said recorded residual signal with said initial sound signal to generate a final sound signal; and feeding said final sound signal into said sound synthesis model, wherein values of said initial sound signal generated by the sound synthesis model depend on values of the final sound signal.

3. A method for producing a residual signal for use in an improved synthesis system, the method comprising the steps of:

constructing an analysis model which combines an analysis input signal with an output signal of a synthesis model to generate an analysis output signal;

feeding a desired signal that represents the desired sound into the analysis model as an analysis input signal;

recording the resulting analysis output signal, wherein the resulting analysis output signal is the recorded residual signal;

using said recorded residual signal as said analysis input signal for the analysis model; and wherein said synthesis model is the inverse of said analysis model.

4. A sound synthesizer comprising:

means for synthesizing a sound signal intended to emulate a desired sound;

means for storing a residual signal which represents the difference between the sound signal generated by the synthesizing means and the desired sound;

the synthesizing means having an input means operably coupled to the storing means for inputting the residual signal into the synthesizing means, such that the synthesizing means uses the residual signal as an input signal when synthesizing the sound signal; and means, operably coupled to the synthesizing means and the storing means, for combining the residual signal from the storing means and the sound signal from the synthesizing means to produce an improved sound signal which emulates the desired sound.

5. A method for improving the accuracy of a sound synthesis model, the method comprising the steps of:

generating a first output signal using the sound synthesis model with a parameter set to a first value;

generating a first residual signal by subtracting the first output signal from a desired signal;

generating a second output signal using the sound synthesis model with the parameter set to a second value;

generating a second residual signal by subtracting the second output signal from the desired signal; and synthesizing sound with the synthesis model having the parameter set to the second value if the second residual signal is smaller than the first residual value.

6. A method for improving the accuracy of a sound synthesis model designed to emulate a desired sound, the method comprising the steps of:

generating an output signal using a sound synthesis model;

subtracting said output signal of the sound synthesis model from a desired signal that represents the desired sound to produce a residual signal;

recording the residual signal;

combining the recorded residual signal with the output signal of the synthesis model to create a final sound signal; and generating a subsequent value of the output signal from the synthesis model using a previous value of the output signal.

7. The method of claim 6 wherein the step of creating an improved synthesis system further comprises:

adding the residual signal to the output signal of the synthesis model to generate a final sound signal; and using a value of the final sound signal in place of the previous value of the output signal when the sound synthesis model generates subsequent value of the output signal.

8. The method of claim 7 wherein:

the sound synthesis model generates output signal values using initial data stored in memory; and the step of subtracting further comprises utilizing said recorded residual signal as said initial data.

9. The method of claim 8 wherein the step of creating an improved synthesis system further comprises using said recorded residual signal when it requires less memory to store in place of the initial data used by the synthesis model.

10. The method of claim 6 wherein the step of recording the residual signal comprises digitally recording the residual signal where a least significant bit of the residual signal is not recorded, thereby reducing memory space required for the residual signal.

11. The method of claim 6 wherein the step of recording the residual signal comprises digitally recording the residual signal where a most significant bit of the residual signal is zero and is not recorded, thereby reducing memory space required for the residual signal.

12. The method of claim 6, wherein the step of recording the residual signal comprises only recording values of the residual signal that correspond to a time interval of shorter than the duration of the desired sound.

13. The method of claim 12, wherein values of the residual signal are greater than a desired minimum value only during the time interval.

14. The method of claim 12, wherein the time interval begins at the start of the desired sound.

15. The method of claim 6, wherein the step of recording the residual signal comprises recording parameters which describe an envelope for the residual signal, thereby reducing memory space required to store the residual signal.

16. The method of claim 15, wherein the step of combining said recorded residual signal with said output signal further comprises:

generating a random signal;

scaling the random signal by a factor dependent upon the parameters which describe an envelope for the residual signal; and adding the scaled random signal to the output signal of the synthesis model.

* * * * *